United States Patent [19]

Heinzmann et al.

[11] Patent Number: 4,563,255

[45] Date of Patent: Jan. 7, 1986

[54] PROCESS AND DEVICE FOR CONTROLLING A CRUST BREAKING FACILITY

[75] Inventors: Ulrich Heinzmann, Zumikon, Switzerland; Werner Braun, Rheinfelden, Fed. Rep. of Germany

[73] Assignee: Swiss Aluminum Ltd., Chippis, Switzerland

[21] Appl. No.: 667,488

[22] PCT Filed: Feb. 9, 1984

[86] PCT No.: PCT/CH84/00019

§ 371 Date: Oct. 1, 1984

§ 102(e) Date: Oct. 1, 1984

[87] PCT Pub. No.: WO84/03108

PCT Pub. Date: Aug. 16, 1984

[30] Foreign Application Priority Data

Feb. 10, 1983 [CH] Switzerland ..... 739/83

[51] Int. Cl.[4] ..... C25C 3/06; C25C 3/14

[52] U.S. Cl. ..... 204/67; 204/245

[58] Field of Search ..... 204/67, 245

[56] References Cited

U.S. PATENT DOCUMENTS 4,377,452 3/1983 Casdas ..... 204/67

*Primary Examiner*—Howard S. Williams

*Attorney, Agent, or Firm*—Bachman & LaPointe

[57] ABSTRACT

In order to control a crust breaker featuring a chisel which can be moved up and down to break the crust on a fused salt electrolytic cell, an electric impedance measuring circuit comprising signal generator and registering instrument is connected between the chisel and the molten electrolyte. As such the generator is preferably in the form of an alternating signal generator, and DC signals, such as operating parameters of the cell and the voltage between the anodes and the cathode, are excluded from the impedance measuring circuit by means of DC neutralizing capacitors.

12 Claims, 2 Drawing Figures

PROCESS AND DEVICE FOR CONTROLLING A CRUST BREAKING FACILITY

BACKGROUND OF THE INVENTION

The present invention relates to a process for controlling a crust breaking facility having a chisel which can be moved up and down to penetrate the crust on top of the molten electrolyte in a fused salt electrolytic cell, and this by detection of the contact made between the chisel and the molten electrolyte, such that changes in signal caused by changes in impedance between chisel and molten electrolyte are detected for control purposes using the chisel as a sensor in an electric measuring circuit, and relates too to a device for controlling a crust breaking facility having a chisel which can be moved up and down to penetrate the crust on top of the molten electrolyte in a fused salt electrolytic cell such that control is made via detection of the contact made between the chisel and the molten electrolyte by means of an electrical measuring circuit with the chisel as a measuring sensor, in which circuit the chisel/molten electrolyte path appears as an impedance element indicating contact.

In the production of aluminum by fused salt electrolysis of aluminum oxide the latter is dissolved in a fluoride melt comprising, for the greater part, of cryolite. The cathodically precipitated aluminum collects on the carbon floor of the cell under the fluoride melt, the surface of the liquid aluminum itself forming the cathode. Dipping into the melt from above are anodes which in the conventional process are made of amorphous carbon. At the carbon anode oxygen is formed as a result of the electrolytic decomposition of the aluminum oxide; this oxygen combines with the carbon of the anodes to form $CO_2$ and CO. The electrolytic process takes place in a temperature range of about 940° to 970° C.

In the course of the reduction process the aluminum oxide i.e. the alumina in the electrolyte is consumed. At a lower concentration of about 1–2 wt.% alumina in the electrolyte the anode effect occurs, which produces an increase in the voltage from for example 4–5 V to 30 V and higher. The cell is therefore usually serviced periodically during normal operation, even when no anode effect occurs. In addition, every time the anode effect occurs the alumina concentration in the electrolyte must be raised by feeding aluminum oxide to the cell.

In the case of hooded cells maximum retention of the cell fumes in the system is obtained if the feeding of the cell takes place automatically at brief intervals. Both the now conventional, local and continuous pointfeeder principle and the discontinuous feeding of alumina along the whole longitudinal or transverse axis of the cell can be employed.

The storage bunkers or alumina silos situated on the reduction cells are generally in the form of funnels or containers with a funnel or conical-shaped lower outlet. The contents of the silos mounted on the cell are usually adequate to supply the cell for one or two days. The silo is therefore also known as a day's supply silo. Up to now the supplying of such a silo with alumina was usually via a closed pipe system, preferably with compact flow feeding from the central alumina supply.

The feeding of the alumina from the day's supply silo to a break in the crust covering the molten electrolyte is usually performed via known devices whereby a flap is swung open for charging purposes, or in another system via feeding screws, measured feed cylinders or measured volumes.

Another device for feeding alumina is such that there is no day's supply silo on the cell, and the measured feeding device is situated away from the cell.

An essential feature of continuous feeding of alumina is that the opening in the crust is always kept open so that the alumina can be fed in measured quantities to the electrolyte. In modern electrolytic cells therefore the alumina feeding and crust breaking facility are always spacially and functionally combined. An electronic process control signal first initiates the raising and lowering of the chisel of the crust breaker, immediately after which the feeding of the alumina takes place.

A mechanically or pneumatically actuated end switch stops the lowering action of the chisel and causes the chisel to return to the resting position. As a result the chisel remains for a period of time in the molten electrolyte where it corrodes relatively quickly and consequently has to be replaced prematurely. Furthermore, crust material remains stuck to the strongly heated chisel and must be wiped off. The amount of compressed air consumed is relatively high.

Known from the French patent publication FR-PS 2 483 965 is a process and a device of the kind mentioned at the start, in which the chisel is used as a measuring sensor in an electric measuring circuit which runs from the chisel to the cathode of the cell via a recording instrument. If the chisel dips into the molten electrolyte, then the direct voltage produced by the electrolytic d.c. current between the molten electrolyte and the cell cathode appears on the recording instrument as a signal that the chisel has made contact with the molten electrolyte and serves as a criterium for control purposes.

Trials have now shown that satisfactory results in the form of an unambiguous criterium for control cannot be obtained with this method. An explanation for this is as follows:

The anode/cathode voltage which or part of which is tapped off by the process according to this French patent publication is subject to fluctuations. As is generally known such molten salt reduction cells are fed with electric current from a single source, a plurality of such cells being connected in series. Consequently the anode/cathode voltages cross the individual cells depend on the resistances prevailing between the anodes and the cathodes, and are not kept constant by a fixed voltage supply. As already mentioned above, the anode/cathode voltage can fluctuate within a large range especially when the anode effect occurs. Such, usually unpredictable fluctuations, which are generally of a magnitude that they disturb the anode/cathode voltage of the cell, affect the measurement if the known method is employed as with that method one measures the voltage of cell operation parameters.

SUMMARY OF THE INVENTION

The object of the present invention is to design a process and invention of the kind mentioned at the start such that the above mentioned disadvantages are avoided. This object is achieved by way of the invention in that the impedance between the chisel and the molten electrolyte is detected by means of an active impedance measurement circuit.

This represents a fundamental deviation from the state of the art measurement circuit with an active signal source in that a current or voltage source is provided and the impedance between the chisel and the molten electrolyte registered by recording the resultant current or voltage signal flowing in the measurement circuit which, at least in the first instance, results from the closing of the measuring circuit by dipping the chisel into the molten electrolyte.

As such the device for breaking the crust is controlled so that the chisel is raised when the impedance, measured via the active impedance measurement circuit, reaches a predetermined minimum value.

In order to keep to a minimum the energy consumed by the crust breaker on the individual cells of a whole unit, the crust breaker has to be operated with as little energy as possible which in normal conditions just suffices to break through the crust. It is proposed therefore that the chisel should be lowered with a given applied force and is monitored to determine whether the minimum impedance value is reached within a given time interval, failing which the applied lowering force is increased.

If, during the predetermined time interval, the minimum impedance value which indicates the crust has been broken has not been reached, then the energy supplied to the crust breaking device is increased by raising the lowering force in order to achieve the penetration of the crust.

Further, the reliability of such a crust breaker is improved in that the time interval to reach, or fail to reach, the minimum value is recorded and, on exceeding a predetermined maximum time interval, a signal is given.

If the time interval during which the chisel remains immersed in the molten electrolyte exceeds a predetermined maximum, then this is an indication that the crust breaker device is not functioning properly.

The device of the kind described at the start is, according to the invention, designed such that the measuring circuit, including an active source and measuring facility, is an impedance measuring circuit.

From this it is clear that the measuring circuit from the chisel must be connected, via active source and measuring facility, to the molten electrolyte preferably via a low resistance contact. Where this contact is situated is of secondary importance. It is therefore possible to arrange this point of contact immediately next to the region where the chisel dips into the molten electrolyte. If this point of contact is, with respect to the operating parameters of the cell, at almost the same potential as the region where the chisel dips into the molten electrolyte, then there is almost zero potential difference between the point of contact and the chisel as the chisel enters the electrolyte. In such a case the measuring circuit remains unaffected by the cell operating parameters, in particular by the anode/cathode voltage, and a direct current impedance measurement can be made.

However, in order to be independent of the cell operating parameters and erratic interference effects, it is proposed that the source is preferably an alternating signal source so that an alternating signal impedance is measured. In principle the measured impedance is then largely independent of the above mentioned cell operating parameters and occasional interference effects if the measuring circuit is connected on the one hand via the chisel and on the other hand via a low resistance contact to the molten electrolyte. At the intended operating frequency the lower the resistance of the impedance elements in the circuit (additional to the chisel/electrolyte impedance), the smaller are the above mentioned effects.

Although it is completely feasible to have the point of connection to the molten electrolyte insulated from the cell i.e. to arrange the whole measuring circuit such that it is electrically detached from the cell, realization is simplified by making the connection to the molten electrolyte a point connecting to the cell itself. This can, for example, be made on the anode or cathode side. If an alternating current source is employed and an alternating impedance current measured, it is proposed further to provide in the circuit DC neutralizing capacitors which balance out from the circuit via direct current the high resistance cell operating parameters but act as low resistance elements on the operating frequency of the measuring circuit.

BRIEF DESCRIPTION OF THE DRAWINGS

The invention is explained by way of example in the following with the aid of the drawings viz.

DETAILED DESCRIPTION

Figure 1:
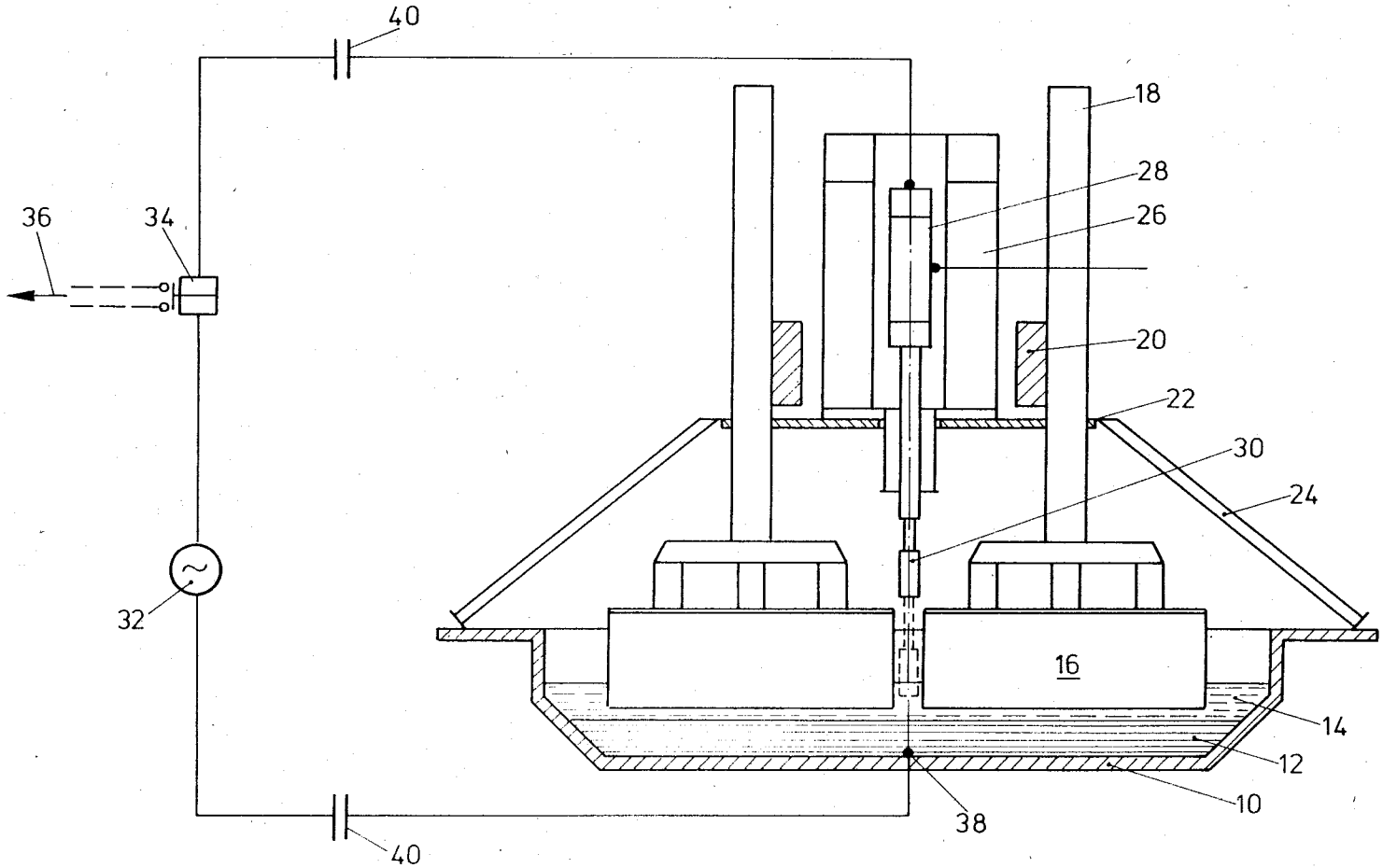
FIG. 1: A schematic vertical cross section through an electrolytic reduction cell featuring according to the invention a measuring circuit with alternating signal source.

Shown in the figures is a steel pot 10 which is lined with a layer of insulation and carbon, not illustrated in detail here for simplification purposes. The carbon floor contains the cathode conductor bars which run in the transverse direction across the cell.

On the carbon floor of the cell is a layer of precipitated, molten aluminum 12, on top of which is a layer of molten electrolyte 14 and a solid crust which is likewise not shown here. Dipping into the molten electrolyte 14 from above are carbon anodes 16 which are suspended via anode rods 18 from the anode beams 20.

The cell hooding comprises a horizontal cover 22 and movable, sloping cover sheets 24 which are electrically insulated from the sidewall of the steel pot 10. The crust breaker 28 is mounted on the anode superstructure 26 and is electrically insulated there to at least 5 kOhm. This crust breaker device pneumatically actuates a chisel 30 which can be moved vertically up and down and is shown here in the resting position above the carbon anodes 16. The lowest working position of the chisel is indicated by broken lines. In that position the chisel dips into the molten electrolyte. The electric circuit, which in FIG. 1 is an alternating current circuit, is closed and the chisel is immediately raised to the resting position.

As shown in FIG. 1 an electric circuit connects the top surface of the crust breaker 28 to a point 38 on the steel pot at the cell cathode potential. This circuit is fed an alternating current from an AC source 32 generating an AC voltage of 24 V. The electronic relay 34 measures the resultant AC signal, which is a function of the circuit impedance, and emits a corresponding signal to the process control unit 36. Two neutralizing capacitors 40 in the AC circuit effect the separation of the DC potential between the electrolytic cell and the electronic process control or relay 34.

Figure 2:
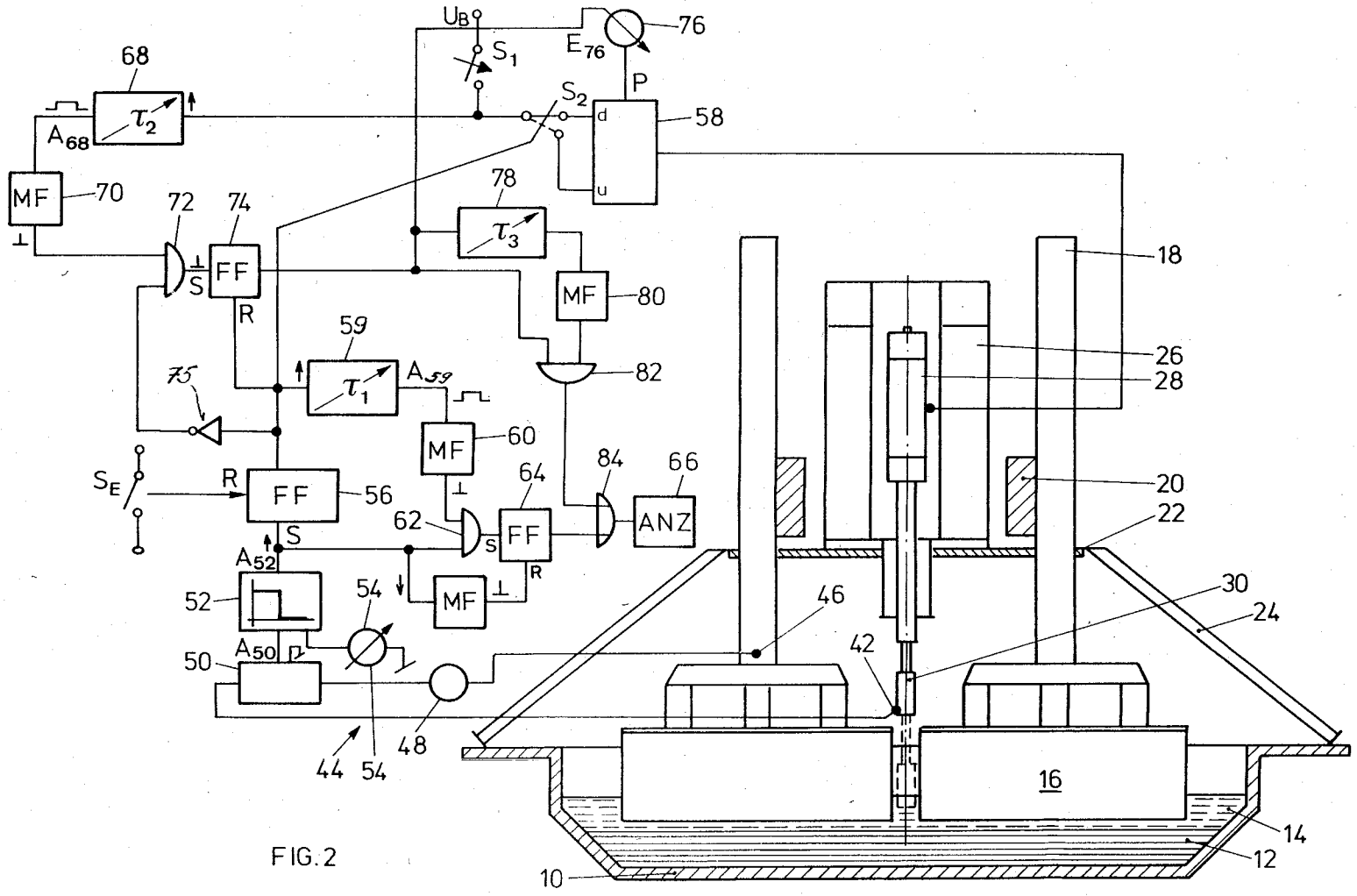
FIG. 2: A representation analogous to that shown in FIG. 1 featuring according to the invention a measuring circuit with different mode of connection, basically for the measurement of direct or alternating current impedance and showing a block diagram for control of the crust breaker.

As shown in FIG. 2 the measuring circuit, indicated as a whole by numeral 44, is connected via connection 42 to the chisel 30, and via another connection 46 to one of the anode support rods 18. The measuring circuit 44 comprises an active signal source 48, a signal generator for DC or preferably AC signals and a current or voltage measuring facility 50 for measuring impedance values. As was described in connection with FIG. 1 the crust breaker is preferably controlled according to the measured impedance signal, preferably via a process control unit. The function chart shown in FIG. 2 indicates how the essential functions of control can be realized in a construction specially designed for this purpose. As already mentioned, in most cases use can be made of process control facilities which would normally be provided anyway. According to FIG. 2 the output $A_{50}$ of measuring facility 50 acts on the input of a comparator unit 52 which receives at a second input a signal from a, preferably adjustable, reference source 54. The comparator unit 52 emits a high level signal only if the output signal from measuring facility 50 does not exceed the pre-selected reference signal from the reference source 54. If the output signal from the measuring facility 50 is proportional to the circuit impedance i.e. the impedance between chisel 30 and anode support 18, then a high level signal is emitted by the comparator unit 52 only if the minimum impedance indicating contact between the chisel and molten electrolyte is registered. If this contact is made, then a bistable unit such as a FLIP-FLOP 56 is set. The crust breaker 28 is triggered pneumatically via control unit 58 with inputs d and u for initiating downward and upward movement of the chisel. To lower the chisel 30, a start switch $S_1$ is thrown and a control voltage $U_B$ fed to the "down" input d of control unit 58 via change-over switch $S_2$ which is then in the position indicated in FIG. 2. The chisel is lowered and makes contact with the molten electrolyte. By setting the bistable element 56 the change-over switch 52 is reversed into the position indicated by the broken line, which initiates via unit 50 the return movement of the chisel 30. With the detection of the chisel/electrolyte contact the rising edge of the signal actuates, at the outlet of the bistable element 56, a time delay switch such as for example a monostable multivibrator 59 with adjustable impulse length $\tau_1$. At the end of the impulse emitted from $A_{59}$ an impulse, generated via a multivibrator 60, is fed to an AND-gate 62.

A second input to AND-gate 62 is connected to the output on the comparator unit 52. As a result the output signal from the monostable multivibrator 60 will arrive at the output of the AND-gate 62, then this indicates that contact between chisel and electrolyte has been maintained during the pre-selected time interval $\tau_1$, i.e. too long. A bistable switch such as a FLIP-FLOP is set so that a signal is given on display unit 66. The FLIP-FLOP 64 is reset with the falling signal edge at outlet $A_{52}$ of comparator unit 52, which indicates that the contact between the chisel and electrolyte has been interrupted again by return movement of the chisel.

On initiating the lowering of the chisel by closing switch $S_1$, a second time delay switch 68, such as a monostable multivibrator with adjustable length of output signal $\tau_2$, is actuated. At the end of the signal of duration $\tau_2$ appearing at the outlet $A_{68}$ of unit 68 a signal is produced via a monostable multivibrator 70. This signal is fed to the AND-gate 72. The signal from the output of monostable multivibrator 70, however, appears at the output of the AND-gate 72 only if the second input of that gate is at logic "1" which with inverter 75 is the case only if the output signal of FLIP-FLOP 56 indicates that contact has not been made between chisel and electrolyte. The signal at the output of gate 72 indicates therefore that, after triggering the downward movement of the chisel and passage of time interval $\tau_2$, there is still no contact between chisel and electrolyte. This indicates that penetration of the crust has not taken place. A bistable switch, FLIP-FLOP 74, is therefore set with the signal appearing at the outlet of gate 72. The outlet from FLIP-FLOP 74 acts on the control input $E_{76}$ of facility 76 with the help of which the compressive force or pressure P, used to drive chisel 30 downwards, is then increased. If the crust is penetrated, then the FLIP-FLOP 74 is reset by the rising edge of the signal at the output of FLIP-FLOP 56: The crust is penetrated. FLIP-FLOP 56 is reset by end switch $S_E$ (indicated only schematically) after the chisel 30 has returned to the uppermost position; the cycle is then complete. It is of course self-evident that, when applying the larger force, the chisel is preferably first returned at least part of the way before a further attempt is made at breaking through the crust. The control facilities for this are not shown in FIG. 2.

If the output signal of the FLIP-FLOP 74 has been set, then a further time delay unit is actuated, for example a monostable multivibrator 78 with adjustable length of signal $\tau_3$, at the end of which another signal is produced via monostable vibrator 80. The output signal from monostable vibrator 80 appears at the AND-gate 82 only if at the same time FLIP-FLOP 74 is still set i.e. only if still working with the larger force on the chisel. This indicates that even with the larger force the chisel has not been able to reach the electrolyte. This condition is also indicated on display unit 66, in this case via an OR-gate 84.

The lowering of the chisel is therefore actuated by control means described in the following as electronic process control system or unit. This can be regulated by closing switch $S_1$ in FIG. 2 at a pre-selected interval e.g. every 1 to 2 minutes, in accordance with the alumina concentration in the electrolyte determined by instrumental analysis, or in accordance with other automated parameters.

The preferred AC voltage source in FIG. 1 can deliver an adjustable voltage preferably between 20 and 40 V, in particular preferably between 20 and 25 V. The total resistance of the AC circuit closed by the molten electrolyte is arranged here such that the AC voltage source delivers a current of some mille-ampere at the selected voltage.

The electronic relay (transducer) built into the AC circuit transmits the signal further to the central electronic process control unit which is normally housed outside the pot room.

As shown in FIG. 1 a capacitor is provided in the AC circuit between the electronic relay and the crust breaker and another between the AC source and the point at the cathode potential. These capacitors effect the separation in potential between the cell, any stray electric currents and the electronic process control system.

All elements of the measuring circuit are situated in the region of the reduction cell but away from the hot, corrosive zone.

With respect to the process the electronic process control effects by means of a signal the lowering of the chisel into the working position and, after contact has been made with the electrolyte, e.g. via the electronic relay, immediate raising of the chisel into the nonoperative position or, if the measuring circuit is not closed within the pre-selected interval $\tau_2$ after the lowering of the chisel, an increase in the pneumatic or hydraulic pressure P on the chisel.

When in the resting position the chisel is situated away from the anodes in order to prevent possible damage to the anodes during changing and also because of thermal and corrosive effects which increase the shorter the distance to the opening in the crust.

When the chisel 30 is lowered into the working position and makes contact with the molten electrolyte, the measuring circuit is closed causing the electronic process control system to terminate the lowering phase immediately and initiate the immediate raising of the chisel to the resting position. A chisel which is already worn or corroded at the lower end does not have any disadvantages effect on the process according to the invention.

If, during the normal lowering procedure, the chisel 30 does not make contact with the molten electrolyte, then the measuring circuit is not completed. After a given interval of time $\tau_2$, for example 5 to 10 seconds after lowering, the electronic process control system initiates an increase in the pressure on the chisel. Usefully under normal operating conditions the crust breaker is operated with reduced pressure of, for example, 3–4 bar. If with this reduced pressure the chisel does not achieve sufficient force, then the electronic process control system switches over to the normal pressure of, for example, 7–8 bar. If this larger pressure is still not sufficient to penetrate the crust, and electrical contact can not be made in the AC circuit after some normal working cycles, then an optical and/or acoustic signal is given. The cell operating personnel can then take the appropriate corrective action. The same signal is given if, for example due to the chisel sticking, the AC circuit remains closed for a time t, longer than the normal working cycle of the crust breaker.

The voltage source in FIG. 1 preferably delivers a voltage between 20 and 40 V, in particular between 20 and 25 V, and such that an alternating current of some mille-ampere flows when contact is made between chisel and electrolyte.

With the device according to the invention and the process according to the invention not only can the feeding of alumina to the cell be controlled but, incidentally, the following supervision performed:

monitoring for defects in the compressed air network monitoring the electrical insulation of the crust breaker from the anodic part of the cell.

What is claimed is:

1. Process for controlling a crust breaker for use with a fused salt electrolytic cell which comprises: providing a fused salt electrolytic cell having a molten electrolyte therein and a crust on top of the molten electrolyte, moving a chisel up and down to penetrate said crust and make contact with the molten electrolyte, detecting the contact made between the chisel and the molten electrolyte by means of an active impedance measuring circuit such that changes in signal caused by changes in impedance between chisel and molten electrolyte are detected for control purposes using the chisel as a sensor in an electric measuring circuit.

2. Process according to claim 1 wherein the chisel is raised when the impedance has reached a given minimum value.

3. Process according to claim 2 wherein the chisel is lowered with a given applied force and is monitored to determine whether the minimum value is reached within a given time interval, failing which the applied lowering force is increased.

4. Process according to claim 3 wherein the interval of time to reach, or fail to reach, the minimum value is registered, and when a given time interval is exceeded a signal is generated.

5. Process according to claim 3 wherein the increasing of the force used to lower the chisel is indicated.

6. Process according to claim 2 wherein the interval of time to reach, or fail to reach, the minimum value is registered, and then a given maximum time interval is exceeded a signal is generated.

7. Device for controlling a crust breaker for use with a fused salt electrolytic cell which comprises: a fused salt electrolytic cell having a molten electrolyte therein and a crust on top of the molten electrolyte, a chisel movable up and down to penetrate said crust and make contact with the molten electrolyte, means for detecting the contact made between the chisel and the molten electrolyte using an electric measuring circuit containing the chisel as a sensor, wherein said circuit is an impedance measuring circuit incorporating active source and measuring facility, in which circuit the chisel/molten electrolyte stretch appears as an impedance element indicating contact.

8. Device according to claim 7 wherein the measuring circuit is closed on the one hand via the chisel and on the other hand via a low resistance contact to the electrolyte.

9. Device according to claim 7 wherein the source is an alternating signal source.

10. Device according to claim 9 wherein the measuring circuit is closed on the one hand via the chisel and on the other hand via a low resistance contact to the electrolyte.

11. Device according to claim 9 wherein the source is connected via a DC neutralizing capacitor arrangement.

12. Device according to claim 8 wherein the low resistance contact is a point of connection to the cell.

* * * * *